US012037147B2

(12) United States Patent
Siewecke

(10) Patent No.: US 12,037,147 B2
(45) Date of Patent: Jul. 16, 2024

(54) FILLING BOX AND METHOD FOR FILLING PACKAGES

(71) Applicant: HAVER & BOECKER OHG, Oelde (DE)

(72) Inventor: Andre Siewecke, Rheda-Wiedenbrück (DE)

(73) Assignee: HAVER & BOECKER OHG, Oelde (DE)

( * ) Notice: Subject to any disclaimer, the term of this patent is extended or adjusted under 35 U.S.C. 154(b) by 524 days.

(21) Appl. No.: 17/281,841

(22) PCT Filed: Sep. 30, 2019

(86) PCT No.: PCT/EP2019/076460

§ 371 (c)(1),
(2) Date: Mar. 31, 2021

(87) PCT Pub. No.: WO2020/070071

PCT Pub. Date: Apr. 9, 2020

(65) Prior Publication Data

US 2022/0119136 A1 Apr. 21, 2022

(30) Foreign Application Priority Data

Oct. 2, 2018 (DE) ..... 102018124348.0

(51) Int. Cl.
*B65B 1/16* (2006.01)
*B65B 1/02* (2006.01)
(Continued)

(52) U.S. Cl.
CPC ..... *B65B 1/16* (2013.01); *B65B 1/02* (2013.01); *B65B 43/36* (2013.01); *B65B 43/465* (2013.01); *B65B 43/60* (2013.01); *B65B 47/10* (2013.01)

(58) Field of Classification Search
CPC .. B65B 1/02; B65B 1/16; B65B 43/36; B65B 43/465; B65B 43/60; B65B 47/10
See application file for complete search history.

(56) References Cited

U.S. PATENT DOCUMENTS 5,682,929 A * 11/1997 Maginot ..... B65B 43/56 141/10
5,727,607 A * 3/1998 Ichikawa ..... B65B 1/28 141/69

(Continued)

FOREIGN PATENT DOCUMENTS

CN 102627156 A 8/2012
CN 114104354 A * 3/2022

(Continued)

OTHER PUBLICATIONS

First Office Action and Search Report received in Chinese Application No. 201980064380.6, dated May 31, 2022.

(Continued)

*Primary Examiner* — Timothy L Maust
(74) *Attorney, Agent, or Firm* — Greer, Burns & Crain, Ltd

(57) ABSTRACT

A packaging system for filling bulk materials into packages, including a filling unit with a filling box, and a filling box for a filling unit of a packaging machine for filling bulk materials into packages, including an upwardly opened takeup space for a package, wherein the takeup space is laterally enclosed by side walls. A partial vacuum device is provided, which is disposed in a corner portion between the side walls. The method for filling packages provides for a package to be guided to the takeup space of such a filling box of a filling unit of a packaging system. The partial vacuum device is then activated for aspirating a flexible wall of a package into the corner portion between the side walls of the takeup space of the filling box.

11 Claims, 4 Drawing Sheets

(51) Int. Cl.

| | |
|---|---|
| ***B65B 43/36*** | (2006.01) |
| ***B65B 43/46*** | (2006.01) |
| ***B65B 43/60*** | (2006.01) |
| ***B65B 47/10*** | (2006.01) |

(56) References Cited

U.S. PATENT DOCUMENTS

| | | | | |
|---|---|---|---|---|
| 5,809,744 | A * | 9/1998 | Villines | B65B 1/26 53/436 |
| 6,321,513 | B1 | 11/2001 | Meixner | |
| 10,173,794 | B2 | 1/2019 | Breulmann | |
| 10,589,881 | B2 | 3/2020 | Vollenkemper et al. | |
| 2010/0012220 | A1 | 1/2010 | Waldron et al. | |
| 2015/0000230 | A1 | 1/2015 | Wright | |
| 2017/0291727 | A1 | 10/2017 | Vollenkemper et al. | |

FOREIGN PATENT DOCUMENTS

| | | | | |
|---|---|---|---|---|
| CN | 217864853 | U * | 11/2022 | |
| DE | 102010001187 | A1 * | 7/2011 | B65B 1/16 |
| GB | 2498216 | A | 10/2013 | |
| JP | H107329931 | A1 | 12/1995 | |
| KR | 20110138972 | A * | 12/2011 | |
| WO | WO-9528322 | A1 * | 10/1995 | B65B 1/16 |

OTHER PUBLICATIONS

International Search Report and Written Opinion received for PCT/EP2019/076460 mailed Dec. 16, 2019.

1 German Search Report received for German Application No. 102018124348.0 dated May 16, 2019.

* cited by examiner

FILLING BOX AND METHOD FOR FILLING PACKAGES

BACKGROUND

The present invention relates to a filling box for a filling unit of a packaging machine for filling bulk materials into packages. Such a filling box comprises at least one takeup space at least partially opened at least upwardly, for at least one package, which takeup space is laterally enclosed by at least two side walls. The packages used may in particular be open-mouth bags. Moreover, the present invention relates to a packaging system having at least one filling unit, comprising at least one such filling box. Furthermore the present invention relates to a method for filling packages by means of such a packaging machine.

The prior art has disclosed a great variety of packaging machines for packaging bulk materials, wherein filling carousels are in particular employed for high output.

Open-mouth bags or valve bags can be filled, depending on the type of machine. The material of the packages intended for filling is also a factor in the configuration of the packaging machine.

For filling, open-mouth bags are as a rule appended to a filling spout and filled while the filling carousel rotates. Large bags tend to be supported on a bag holder.

Specifically in the case of smaller packages it is preferred, however, depending on the configuration, for the package respectively the bag intended for filling, to be placed in a so-called filling box and to be filled in the filling box, while rotating on or with the filling carousel.

Depending on the configuration, the packages or open-mouth bags can be manufactured in a bag manufacture upstream of the filling carousel, and transferred into a filling box by means of a transport box.

In the case of packages placed or inserted in a filling box, the usually flexible walls of the package may cave in at least slightly, since the package is freely standing in the filling box and is not appended from a filling spout. This may result in a less than optimal filling opening and/or in preventing the insertion of a plug for compacting the bulk materials into the package mouth.

EP 3 197 784 B1 proposes aspirating the flexible walls of the package through openings in the sidewalls of the filling box, to thus prevent the package mouth from caving in. The drawback thereof is that the side walls of the package immediately bear against the side walls, as soon as they make contact with the partial vacuum prevailing in the openings. Thus, the flexible walls of the package bear against the side walls of the filling box more or less uncontrolled, so that although the package mouth is as a rule kept open, optimal shaping of the package contour cannot always be achieved.

It is therefore the object of the present invention to improve the drawbacks described above.

SUMMARY

The filling box according to the invention for a filling unit of a packaging machine for filling bulk material into packages comprises at least one takeup space at least partially open at least upwardly, for at least one package. This takeup space is laterally enclosed by at least two side walls. According to the invention, at least one partial vacuum device is provided, which is disposed at least in sections in at least one corner portion between the at least two side walls.

The filling box according to the invention allows a package introduced into the filling box to be tightened into the corner portions of the takeup space by means of the partial vacuum device, so that the preferably flexible wall of a package or the shape of the package is optimized into the corners of the takeup space. Preferably, all the corner portions are provided with partial vacuum devices, so that the shape is optimally tightened into the corners.

According to the invention, a corner portion is in particular understood to mean, the edge or the corner between at least two side walls. If only two side walls are provided, the corner portions of these side walls are preferably edges, wherein the two side walls give the takeup space an approximately oval shape. In the case of three side walls, the contour of the shaping box can be made triangular, wherein again, partial vacuum devices are disposed, preferably in all the three corner portions respectively in the corners between the side walls. Given more than three side walls, filling boxes may be shaped in any polygonal contour desired.

The filling box according to the invention offers many advantages. It is a considerable advantage that the preferably flexible wall of the package is optimally tightened wholly into the corners by means of the one or more partial vacuum devices disposed in the corner portions, so as to give the package an optimal shape or contour inside the takeup space.

As soon as the preferably optimal package shape or the predetermined package cross section is shaped wholly into the corners of the takeup space, a vacuum can be generated, preferably additionally or solely, on the side walls of the takeup space. To this end, openings can in particular be provided in the side walls, through which air can be aspired and thus, a vacuum generated.

This may ensure reliable filling of bulk material through a completely opened package mouth. Moreover, a plug configured the closest possible to the contour, for compacting the bulk materials, can be reliably inserted into the package.

In convenient configurations, the partial vacuum device generates a vacuum in the corner portion by way of drawing air out of the takeup space. In these configurations, where the partial vacuum device generates a vacuum by sucking off, the corner portion is preferably configured as a hollow ridge, so as to allow sucking off air and tightening or shaping the flexible package wall wholly into the corners.

Preferably, the partial vacuum device comprises at least one Venturi device. A Venturi device is preferably configured such that by way of generating an air flow, i.e. by blowing out air, a vacuum is generated in the corner portion, so that the contour of a package is optimized or tightened completely into the corners. The vacuum is generated in particular when a package is introduced into the filling box, and the air flow passes between the filling box and the package. Thus, generating a directed air flow according to the Venturi principle generates a vacuum between two surfaces.

Particularly preferably, the Venturi device comprises at least one nozzle, which is, at least in sections, disposed in at least one corner portion. By means of such a nozzle, which in particular provides at least one air outlet, air can be blown out inside the takeup space along the corner portion or along the edge between at least two side walls.

In useful configurations, the takeup space is configured upwardly conical, at least in sections. This is in particular understood to mean that the takeup space becomes wider, at least in sections, in the direction of the top opening, or upwardly, than the package accommodated in the takeup space.

In advantageous configurations, the nozzle of the Venturi device is oriented such that a generated air flow is directed toward the top opening of the takeup space. In this way, as soon as a package is placed in the shaping box, a vacuum is generated by the upwardly streaming air flow between the corner portion and the package wall.

Preferably the nozzle is disposed in the top half, preferably in the top third, and in particular in the top quarter of the filling box respectively the takeup space. It is particularly preferred that at least the top portion of a package and preferably the region of the opening of the package is completely drawn into the corner portions of the filling box, so that at least the opening bears against the filling box in a form-fit.

In convenient specific embodiments, at least one suction device is provided, with at least one side wall provided with at least one opening connected with the suction device. Such an opening in at least one side wall, through which a vacuum is obtained in the shaping box by sucking off air, allows to additionally aspirate through the side walls, the preferably flexible wall of a package, in particular wrinkle-free, to the side wall of a filling box. This achieves a most optimal bearing of the package against the shaping box, so that the package can be reliably filled and moreover optimally compacted by means of a plug close to the contour.

Particularly preferably at least one suction device is provided, wherein the bottom of the takeup space is provided with at least one lower opening that is connected with the suction device. In convenient configurations, such a suction device allows to suck the package into the shaping box respectively to support the package when gliding into the takeup space. Providing such a suction device in the lower region or through an opening in the bottom of the takeup space ensures the complete insertion of an empty package into the shaping box.

In advantageous configurations the suction device comprises at least one fan device. Such a fan device allows aspirating air out of the filling box. This is a particular advantage if no other vacuum port is provided.

The packaging machine according to the invention for filling bulk materials into packages comprises at least one filling unit with at least one filling box, as described above.

The packaging machine according to the invention for filling bulk material also shows the advantages described above regarding the filling box.

The method according to the invention is suitable for filling packages with bulk material by means of a packaging system as described above. The package is first guided toward the takeup space of the filling box of a filling unit. Thereafter the partial vacuum device is at least temporarily activated, to aspirate at least one flexible wall of at least one package at least temporarily in at least one corner portion between at least two side walls of the takeup space of the filling box.

This ensures reliable filling of bulk material through a completely opened package mouth. This results from the fact that generating a vacuum in the corner portions of the shaping box, causes optimizing or tightening the preferably flexible wall of a package entirely into the corners. Thus it is achieved that the predetermined contour of a package is optimally generated up into the filling box.

Furthermore, the tightening or clamping of the package up into the corner portions of the filling box enables inserting into the package, a plug which is close to the contour, for compacting the bulk materials as closely as possible to the contour of the filling box.

Thus, the method according to the invention again shows the advantages indicated above regarding the packaging machine and the filling box.

Preferably the suction device generates, at least temporarily, a vacuum at least at one opening in at least one side wall. It is thus achieved that the bag already optimized in the corners or the package optimized into the corners, is also aspirated to the side walls preferably across its surface, by way of at least one flexible wall, so as to ensure particularly optimal filling and compacting of the bulk materials.

Particularly preferably the suction device for generating a vacuum at least at one opening in at least one side wall is activated only while the partial vacuum device is not optimizing the package into the corner portion or portions of the shaping box. In this way it is achieved that the walls of the package bear against the side walls of the filling box wrinkle-free as far as possible. The suction device into the corners may be activated preferably prior to optimizing and after optimizing. If a powerful partial vacuum device is provided, the suction device may optionally run continuously.

BRIEF DESCRIPTION OF THE DRAWINGS

Further advantages and features of the present invention can be taken from the exemplary embodiments which will be discussed below with reference to the enclosed figures.

These show in.

DETAILED DESCRIPTION

Figure 1:
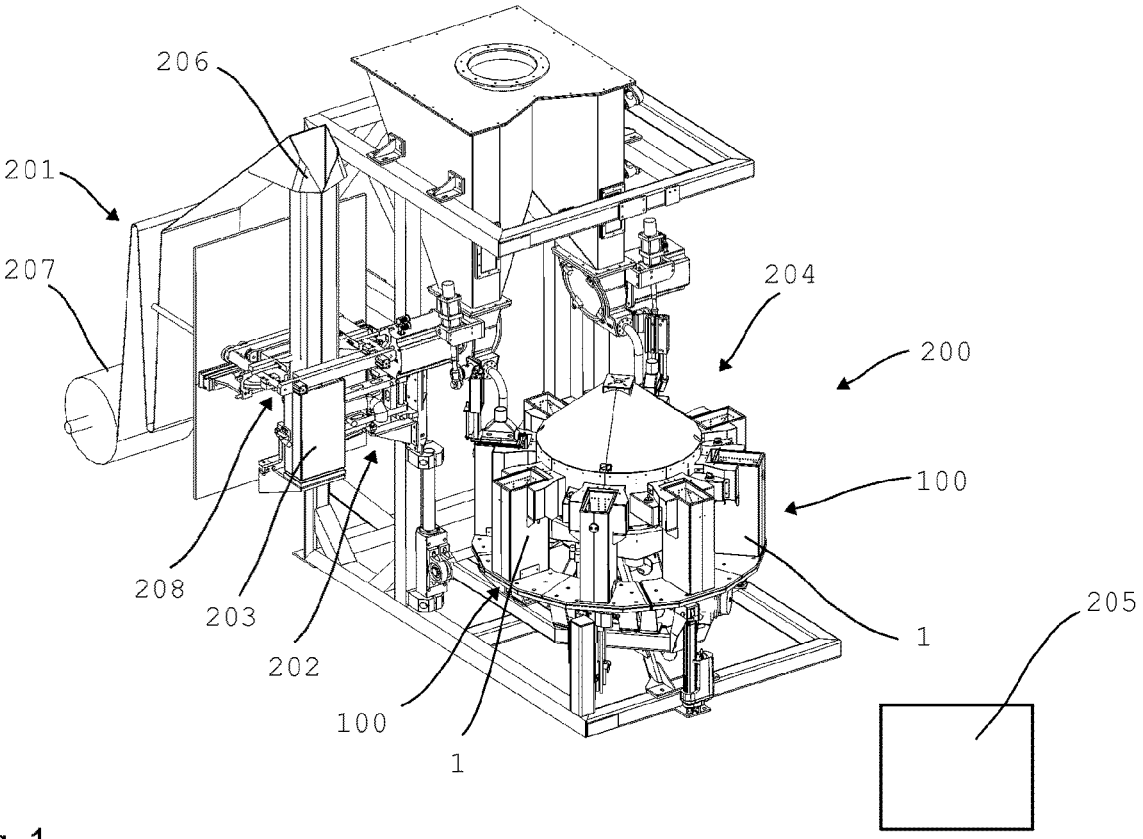
FIG. 1 a schematic illustration of an exemplary embodiment of a packaging machine according to the invention in a perspective view.

FIG. 1 schematically illustrates a packaging machine 200 according to the invention for filling bulk materials 50 into packages 60 in a perspective view.

The packaging machine 200 in the exemplary embodiment shown, comprises a package manufacturing device 201, which manufactures packages 60 and in particular open-mouth bags 62 for packaging bulk material 50.

The package manufacturing device 201 in the exemplary embodiment shown manufactures flexible open-mouth bags 62 of a film. To this end, film is unrolled from a film reservoir 207 and guided across a shaping shoulder 206. In the exemplary embodiment shown, a film section thus placed around a shaping box is shaped by a welding and cutting station 208 to make a flexible open-mouth bag, which is transferred to the transport box 203 of a transfer device 202.

Moreover the packaging machine 200 comprises a filling carousel 204, over the circumference of which multiple filling units 100 are disposed. Each of these filling units 100 comprises a filling box 1, into which packages 60 are separately inserted for filling.

To this end, the transfer device 202 moves the transport box 203 to a suitable position above an empty filling box 1, wherein the transport box 203 guides the package 60, presently the open-mouth bag, into the filling box 1.

During rotation of the filling carousel 204, one bag 62 each is filled in a filling box 1. Thereafter, or in parallel, the bulk material 50 in the package 60 can be compacted. In the exemplary embodiment shown, it is schematically indicated that the filling carousel 204 is followed by a downstream compaction station 205.

Figure 2:
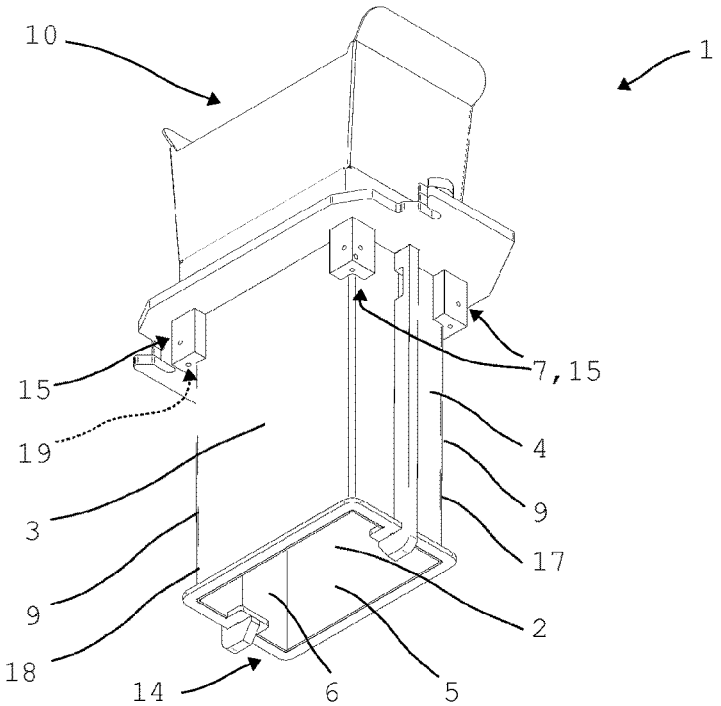
FIG. 2 a schematic illustration of an exemplary embodiment of a filling box according to the invention in a perspective view.

FIG. 2 schematically illustrates a perspective view of a filling box 1, which comprises a takeup space 2 for a package 60 intended for filling. In the exemplary embodiment shown, the filling box comprises four side walls 3, 4, 5, 6, which define a takeup space 2. In each of the corner portions 9 of the top section of the filling box 1, a partial vacuum device 15 is disposed, which generates a vacuum in the corners 17 or along the edges 18.

The filling box 1 comprises a top opening 10 and in the bottom 13 of the filling box 1, a lower opening 14. Depending on the exemplary embodiment, a suction device 11 may be provided beneath the lower opening 14, which supports conveying the empty packages from a transport box 203 into the filling box 1.

Such a suction device 11 may for example be provided by a fan device 16, which operates the suction device 11 so as to draw the package 60 downwardly as far as into the takeup space 2 of the filling box 1.

The packages 60 introduced or placed in the filling box 1 are preferably open-mouth bags 62 with more or less flexible bag walls. In order to have the predetermined shape or contour of the package 60 bear in a form-fit against the filling box 1 or the takeup space 2 of the filling box 1, for filling and primarily also for later compacting with the plug 209 the closest possible to the contour, partial vacuum devices 15 according to the invention are provided, presently disposed in the corner portions 9 between the side walls 3, 4, 5, 6.

When a vacuum is generated in the corner portions 9, the package 60 is optimized as far as into the corners 17 or the edges 18 of the filling box 1 respectively of the takeup space 2, or the package 60 is tightened into the corners 17 or the edges 18. The predefined shape of the package 60 is thus optimized.

In order to generate a vacuum in the corner portion 9 or in the corners 17 or along the edges 18, a vacuum may for example be aspirated into the corner portion 9 through suitable openings. Then, preferably at least one suction line is provided, which draws in a vacuum at the openings. Then, the corner portion 9 or the edge 18 is preferably shaped as a hollow ridge between each of the side walls 3, 4, 5, 6. Depending on the application, such a configuration can be employed expediently, although it is not illustrated in the Figures shown.

The partial vacuum device 15 in the exemplary embodiment shown is configured as a Venturi device 7, presently provided by separate components, each being attached externally to the corner portions 9 respectively the edges 18 or corners 17 between the side walls 3, 4, 5, 6.

The Venturi device 7 comprises a nozzle 8, provided to be connected with a pressure line 19. Air is blown into the takeup space 2 through this pressure line 19.

Since the nozzles 8 of the Venturi devices 7 in the exemplary embodiment shown are configured and disposed such that the air flow 20 is guided toward the top opening 14 along the edges 18, the air flow 20 is blown out through the top opening 10 between the corner portions 9 and the already placed package 60. The air flow thus prevailing between the package 60 and the side walls 3, 4, 5, 6 generates a vacuum according to the Venturi principle, whereby the bag walls are drawn into the corner portions 9 or into the corners 17 or the edges 18.

Figure 3:
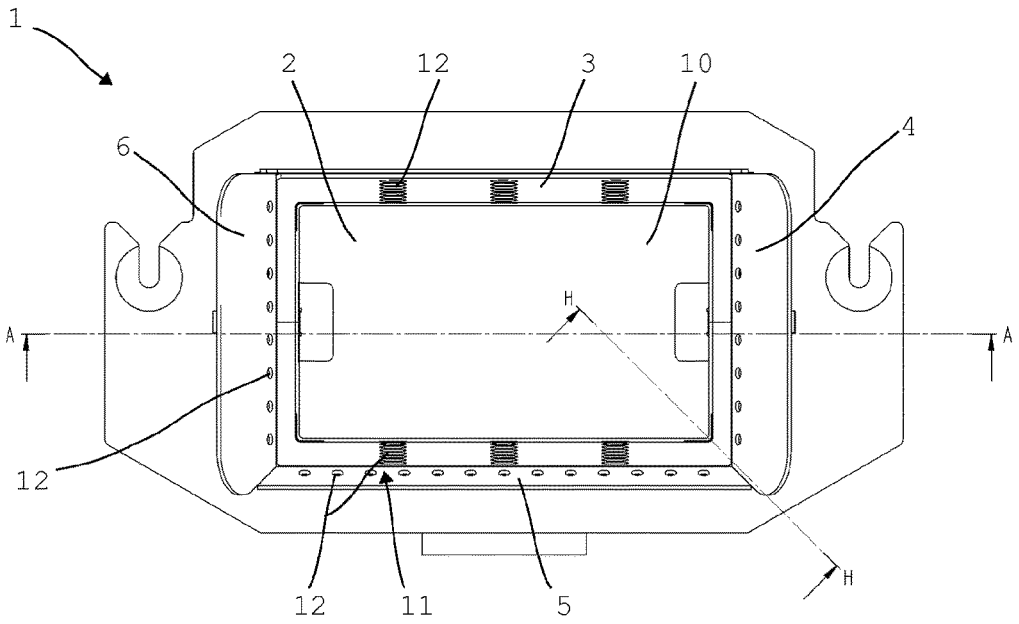
FIG. 3 a schematic illustration of an exemplary embodiment of a filling box according to the invention in a top view.

FIG. 3 schematically illustrates the embodiment already shown in FIG. 2 in a top view. In this view one can see through the top opening 12 into the takeup space 2 of the filling box 1, which is enclosed by the side walls 3, 4, 5, 6.

In this view one can see that the takeup space 2 widens upwardly slightly conically. Thus, one can also see in this view, the openings 12 of the suction device 11 in the side walls 3, 4, 5, 6.

The suction device 11 is in functional connection with the openings 12, so that air can be sucked off through these openings 12, whereby the walls of the package 60 bear in a form-fit against the side walls 3, 4, 5, 6 of the takeup space 2 of the filling box 1.

However, a vacuum is preferably applied to these openings 12 only if the partial vacuum device 15 does not tighten the contour of the package 60 as far as into the corners 17 respectively the edges 18. If the partial vacuum device 15 is configured in a suitable strength, the suction device 11 may apply a permanent vacuum on the openings 12. It is thus achieved that the bag walls or package wall bear against the takeup space 2 wrinkle-free.

Figure 4:
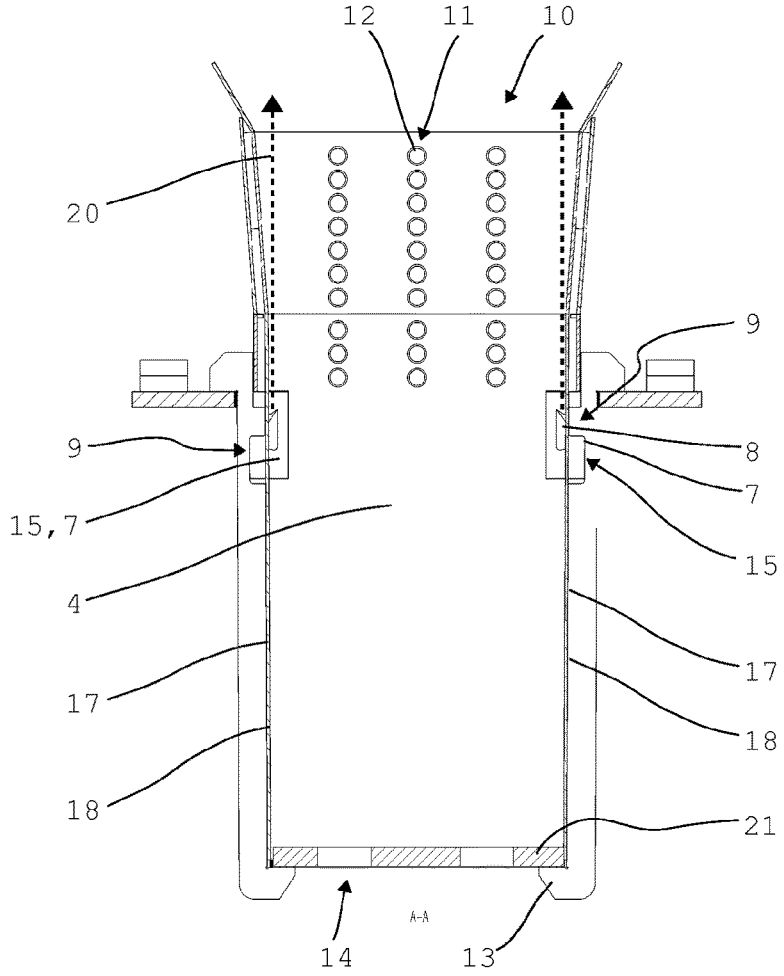
FIG. 4 a schematic illustration of the filling box according to the cutting line A-A in FIG. 3.

FIG. 4 schematically shows another exemplary embodiment according to the present invention in a sectional, lateral view. Again one can identify the top opening 10. One can see in section, the configuration of the Venturi device 7 or the nozzle 8 of the Venturi device 7 in the corner portions 9 between the side walls 3, 4, 6.

This Figure schematically indicates that an air flow 20 is blown out toward the top opening 10 through the nozzle 8 of the Venturi device 7. As soon as a package 60 is disposed in the filling box 1, the passing of the air flow 20 between the side walls 3, 4, 5, 6 and the package 60, generates a vacuum, whereby the package is drawn fully into the corners 17 or the edges 18.

As soon as this happens, the suction device 11 can start up, whereby a vacuum is applied to the openings 12 in the side walls 3, 4, 5, 6, so that the wall of the package 60 is sucked against the side walls 3, 4, 5, 6 of the filling box 1 wrinkle-free. Using a suction device 11 and openings 12 in the side walls 3, 4, 5, 6 is optional though.

To better illustrate the function of the filling box 1, a gliding plate 21 or bottom plate 21 is schematically shown, which is preferably removably inserted in the shaping box 1 and on which the package 60 inserted into the takeup space 2 rests. The package 60 can be guided on this gliding plate 21 on a suitable gliding surface of the filling carousel 204. However, FIG. 4 shows a configuration in which the gliding plate 21 is retained by holding fingers, wherein the configuration including holding fingers can in particular be employed in a compaction station 205. In the case of a filling box 1, the holding fingers can be omitted since the gliding plate 21 is supported on the gliding surface. Then the gliding plate 21 preferably includes passages for aspiring air out of the takeup space.

Figure 5:
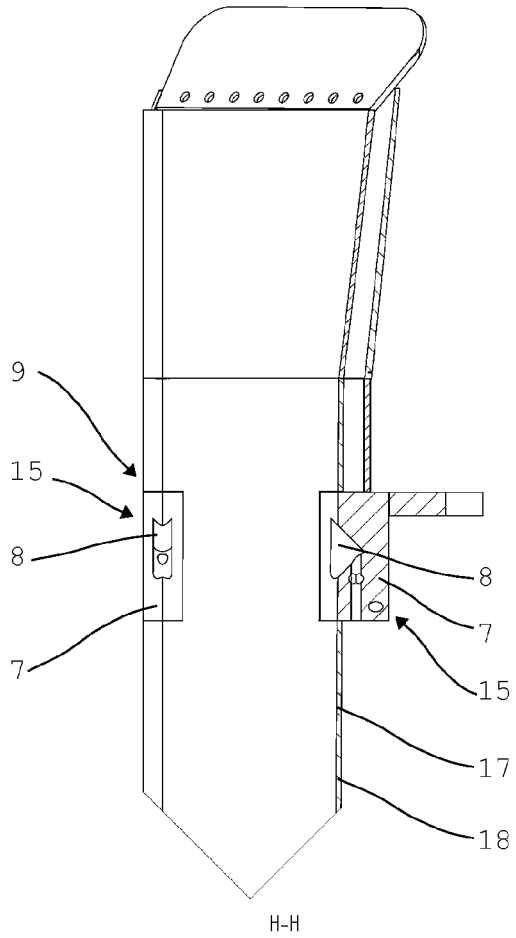
FIG. 5 a schematic illustration of the filling box according to the cutting line H-H in FIG. 3
Figure 6:
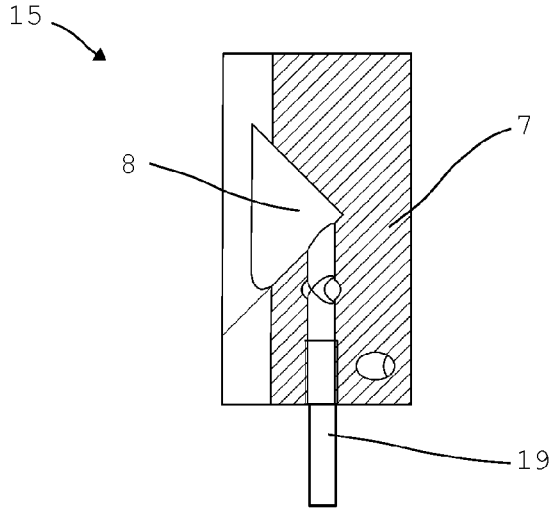
FIG. 6 a schematic illustration of an enlarged section of a partial vacuum device.

The FIGS. 5 and 6 illustrate sectional views of the configuration of the partial vacuum devices 15 in the corner portions 9 respectively the nozzles 8 of the Venturi devices 7.

Figure 7:
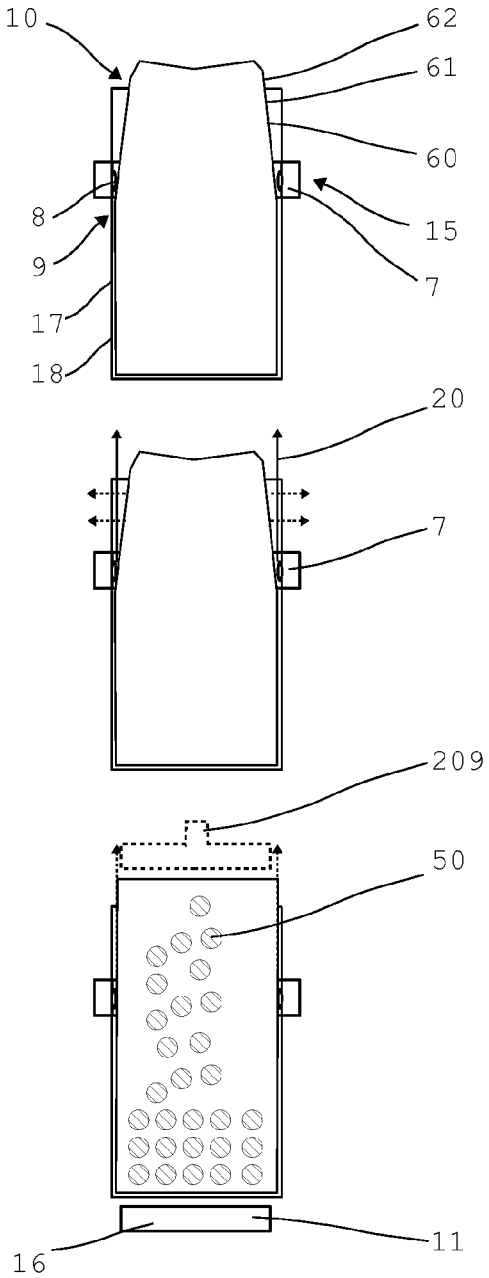
FIG. 7 a schematic illustration of the operating method of the present invention.

FIG. 7 schematically illustrates the sequence of the method according to the invention. In the top view one can see that a package 60 with flexible walls has been inserted in the filling box 1.

The flexible walls 61 of the package 60 cause these to slightly tilt inwardly in the top region or in the region of the top opening 10 of the filling box 1. On the one hand, the package 60 cannot be filled over the whole width of the opening in this state. Moreover, no plug 209 close to the contour can be inserted into the package or the package mouth, for compacting the bulk material 50 filled into the package 60.

In order to ensure optimal shaping of the package 60 in the takeup space 2 of the filling box 1, partial vacuum devices 15 are provided in the corner portions 9 between the side walls 3, 4, 5, 6, which in the exemplary embodiment shown are also configured as Venturi devices 7.

Due to the package 60, which is configured as an open-mouth bag 62 and is positioned in the filling box 1 or in the takeup space 2, the blowing out of air toward the top opening 10 by means of the Venturi devices 7 generates a vacuum in the corner portions 9 or along the edges 18 and the package walls 61.

Thus, the package or the open-mouth bag 62 is optimally drawn wholly into the corners 17 or the edges 18 between the side walls 3, 4, 5, 6, whereby the open-mouth bag 62 is tightened completely into the corners 17 or edges 18. Thus, bulk material 50 can be optimally filled into the open-mouth bag 62, and can be compacted for example by means of a plug 209 close to the contour, of a compaction station 205.

Furthermore, FIG. 7 once again illustrates schematically that beneath the filling box 1, at least in the region of the transfer station, 202 a suction device 11 with a fan device 16 may be provided, so as to suck in, through the bottom opening 14 in the bottom 13 of the filling box 1, the package 60 wholly downwardly into the takeup space 2 of the filling box 1.

While a particular embodiment of the present filling box and method for filling packages has been described herein, it will be appreciated by those skilled in the art that changes and modifications may be made thereto without departing from the invention in its broader aspects and as set forth in the following claims.

LIST OF REFERENCE NUMERALS

1 filling box
2 takeup space
3 side wall
4 side wall
5 side wall
6 side wall
7 Venturi device
8 nozzle
9 corner portion
10 top opening
11 suction device
12 opening
13 bottom
14 bottom opening
15 partial vacuum device
16 fan device
17 corner
18 edge
19 pressure line
20 air flow
21 gliding plate/bottom plate
50 bulk material
60 package
61 flexible wall
62 open-mouth bag
100 filling unit
200 packaging machine
201 package making device
202 transfer device
203 transport box
204 filling carousel
205 compacting device
206 shaping shoulder
207 film reservoir
208 welding and cutting station
209 plug

The invention claimed is:

1. A filling box for a filling unit of a packaging machine for filling bulk material into packages, comprising: at least one takeup space for at least one package, wherein the takeup space is laterally enclosed by at least two side walls;

at least one partial vacuum device is provided, which is disposed at least in sections in at least one corner portion between the at least two side walls;

the partial vacuum device comprises at least one Venturi device having at least one nozzle; and the nozzle is oriented such that a generated, blown air flow is directed toward a top opening of the takeup space so that the blown air flow passes between the filling box and a package introduced into the filling box, so that a vacuum is generated in the at least one corner portion between the filling box and the package by the blown air flow that is directed toward the top opening of the takeup space, so that the contour of a package is tightened completely into the at least one corner portion.

2. The filling box according to claim 1, characterized in that the at least one nozzle is disposed at least in sections in the at least one corner portion.

3. The filling box according to claim 1, characterized in that the takeup space is configured upwardly conical, at least in sections.

4. The filling box according to claim 1, characterized in that the nozzle is disposed in a top half of the filling box.

5. The filling box according to claim 1, characterized in that at least one suction device is provided and that said at least one side wall comprises at least one opening which is connected with the suction device.

6. The filling box according to claim 1, characterized in that at least one suction device is provided, and that a bottom of the takeup space comprises at least one bottom opening, which is connected with the suction device.

7. The filling box according to claim 5, characterized in that the at least one suction device comprises at least one fan device.

8. A packaging system for filling bulk materials into packages, comprising at least one filling unit with at least one filling box according to claim 1.

9. A method for filling packages with bulk materials by means of a packaging system according to claim 8, wherein a package is guided to the takeup space of the filling box of a filling unit, wherein the partial vacuum device comprising at least one Venturi device having at least one nozzle is at least temporarily activated, to aspirate at least one flexible wall of at least one package at least temporarily in at least one corner portion between at least two side walls of the takeup space of the filling box; and wherein blown air flow is generated by the nozzle, wherein the blown air flow is directed toward a top opening of the takeup space so that the blown air flow passes between the filling box and a package introduced into the filling box, so that a vacuum is generated in the at least one corner portion between the filling box and the package by the blown air flow directed toward the top opening of the takeup device, so that the contour of the package is tightened completely into the at least one corner portion.

10. The method according to claim 9, characterized in that the suction device generates at least temporarily a vacuum at least at one opening in at least one said side wall.

11. The method according to claim 10, characterized in that the suction device is activated only while the package is not being tightened into the corner portion by means of the partial vacuum device.

* * * * *